United States Patent [19]

Becker et al.

[11] 4,200,803

[45] Apr. 29, 1980

[54] MULTIPLE COLLIMATOR APPARATUS WITH ANGULARLY ADJUSTABLE COLLIMATOR TUBES

[75] Inventors: Veit Becker; Ludwig Feinendegen; Max Pollermann, all of Jülich, Fed. Rep. of Germany

[73] Assignee: Kernforschungsanlage Jülich Gesellschaft mit beschrankter Haftung, Jülich, Fed. Rep. of Germany

[21] Appl. No.: 893,784

[22] Filed: Apr. 5, 1978

[30] Foreign Application Priority Data

Apr. 6, 1977 [DE] Fed. Rep. of Germany ..... 2715364
Mar. 7, 1978 [DE] Fed. Rep. of Germany ..... 2809679

[51] Int. Cl.[2] ..... G21F 5/04
[52] U.S. Cl. ..... 250/505; 250/511
[58] Field of Search ..... 250/505, 511, 512, 513

[56] References Cited

U.S. PATENT DOCUMENTS 2,659,017 11/1953 Bartow ..... 250/511
3,997,794 12/1976 York ..... 250/511

*Primary Examiner*—Craig E. Church

*Attorney, Agent, or Firm*—Frishauf, Holtz, Goodman & Woodward

[57] ABSTRACT

In addition to a fixed collimator bore on the upper part of which a detector for gamma rays can be mounted, a lead plug or plate body has mostly conical bores in which angularly adjustable collimator tube bodies are seated. In one embodiment the lower part of the mostly conical bore is widened to provide a ball joint with an enlarged part of a collimator body which permits swiveling in any direction within the limits imposed by the walls of the conical part of the bore in the lead plug. In another embodiment intermediate rotary conical bodies are mounted in the shield plug and the collimator bodies either swivel about a horizontal axis that can be rotated by turning the intermediate body, or else the collimator body itself is a rotary cone frustum with an eccentric collimator bore for adjustment of the angle of inclination of the collimator orientation. The collimator bodies and, if used, the intermediate bodies, are made to contribute to the shielding against disturbing radiation. The invention is useful in precisely measuring the distribution of radiation from a portion of a living body that has been marked by the accumulation of a radioactive tracer substance.

7 Claims, 7 Drawing Figures

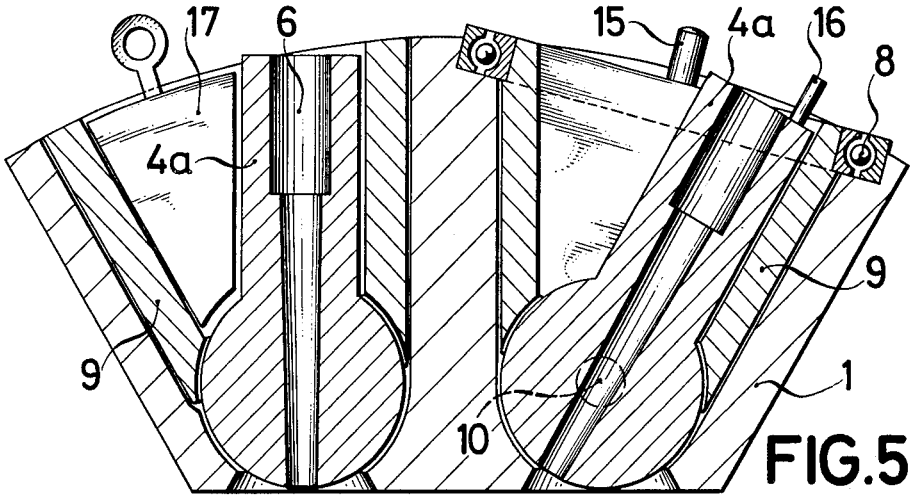
FIG.5
FIG.4
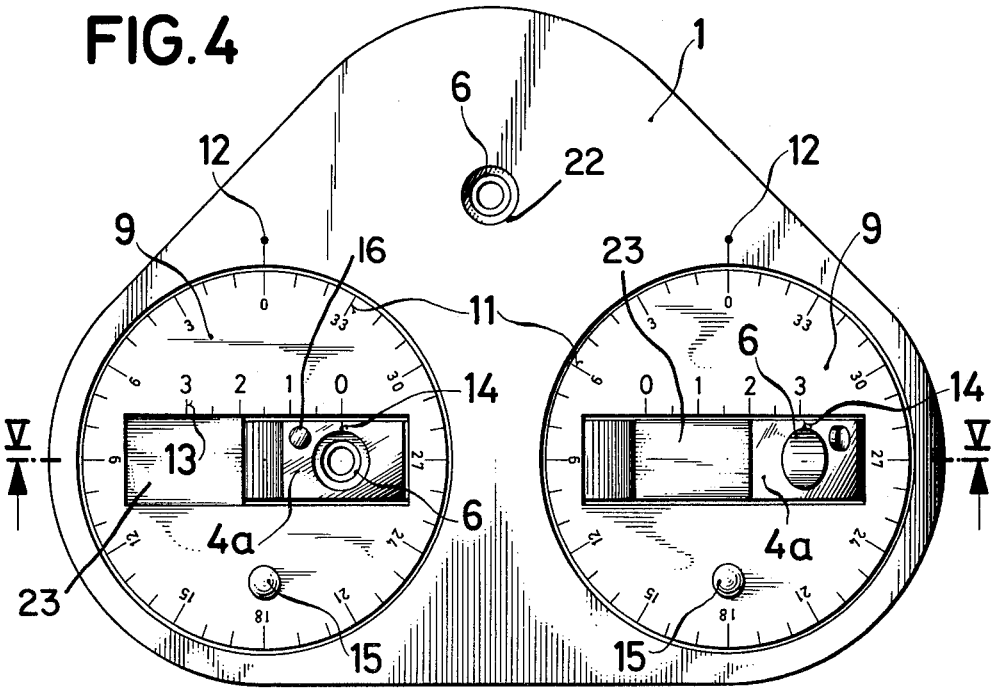

MULTIPLE COLLIMATOR APPARATUS WITH ANGULARLY ADJUSTABLE COLLIMATOR TUBES

This invention concerns a multiple collimator apparatus for determining the distribution of radiation from a radioactive source. Such devices generally include a shield block or plate having spaced bores through it in which measuring probes may be inserted for measuring the radiation collimated by the respective bores.

Such multiple collimator apparatus are used in nuclear medical diagnosis when radioactive marking substances have been incorporated in the organs or other body parts to be explored and the radiation for this purpose is generally gamma-ray radiation. It is intended that the radioactive radiation registered in each of the detectors or probes should be related to the respective locations at which the detectors are aimed by the respective bores through the shield plate or block through which they "look." Collimators of various kinds of construction are known. Thus there are collimators for individual probes or detectors (cf. G. J. Hine "Instrumentation in Nuclear Medicine," Academic Press, New York/London, 1967, vol. I, pages 429 to 460) providing a generally cylindrical or sometimes conical bore through a lead shield. The lead shield prevents radioactive rays from regions outside the scope of view of the bore from reaching the measuring detector and thereby affecting the measurement. This function is also served when two or more bores each with a different field of view and each serving a separate detector are provided through the same lead shield.

Multiple collimators are known in which a multiplicity of similar bores are arranged at regular spacing in a lead plate. Such collimators, which are called multiple collimators, make possible the coverage of a large region of an object to be investigated by a search raster and thereby to provide an image of the entire object field with gamma-ray cameras (cf. H. O. Anger, "Scintillation camera with multi-channel collimators," J. Nucl. Med., 1964, page 515).

Combined collimators are also known in which several individual collimators are combined into a collimator block (cf. H. W. Pabst, G. Hör, H.A.E. Schmidt; Nuclear Medicine "Fortschritte der Nuclear-Medizin in klinischer and technologischer Sicht," S. K. Schattauer-Verlag, Stuttgart/New York, 1975, pages 74 to 77). In a particular case it may be sought to reduce the extent of space occupied by such a combination of collimators. In such a way it has been successful to measure object fields and also functional studies of individual organs, for example of the heart, where separate time-activity measurements can be made for different regions of the organ. Such combined collimators, however, just as the other kinds of collimators mentioned above, do not in all cases meet the requirements of medical diagnosis, for a fixed combination of several collimators in one block has the disadvantage that it is not possible to fit the various individual characteristics of organs under investigation. This is already evident because the organs, as for example the heart, are different for each patient with regard to size, shape, position and configuration to an extent that cannot be neglected. Multiple collimators available up to now have the disadvantage that they are not usable for masking out all but a discrete measuring field from a larger field or are usable in that way only with additional provisions which must be depended on in order to assure a shielding effect with respect to everything outside the selected field of view. Furthermore, the cost of the required precautions does not stand in any acceptable ratio to the experimental results desired. If individual collimators are used that are movable with respect to each other in order to cover a discrete object field, the disadvantage arises that the necessary shielding for each individual device tends to interfere with the other devices, as a result of which the detectors cannot be collected together so closely as would be desirable for the measurement.

It is an object of the present invention, therefore, to provide a collimator device for the simultaneous use of several detector probes that permit the setting of the detector probes, appropriately for the organ to be investigated, to conditions closely fitting the requirements of diagnosis work in nuclear medicine, while at the same time providing adequate shielding against disturbing rays.

SUMMARY OF THE INVENTION

Briefly, detectors and collimator tubes through which they "look" are mounted so as to pivot either about an axis or a point in their mounting within a shield plate or block, generally referred to as a shield plate. One of the probes can "look" in a fixed direction without loss of flexibility of the arrangement, since if all the others can be swung, the relation, among the probes, of their various directions of sensitivity is fully adjustable. The pivoted mounting in the shield plate is so organized that a particular region of a body organ under examination can be brought within the optical scope of all of the measuring probes or detectors under a wide range of variable conditions (for example, spacing from the shield plate) and nevertheless in each position of the measuring probes there is sufficient shielding against disturbing radiation from directions not relevant to the measurement.

On the basis of the foregoing principle, bores are made in the shield plate having a bearing shell-shaped widened portion for providing an articulated joint with a collimator tube and the remaining portion of the bore as it leads away from the widened portion is divergent in at least one transverse direction. A collimator tube into which a detector probe can be fitted is provided in each bore of the kind just described having a bearing portion fitting the shape of the bearing shell-shaped widened portion of the bore, so that the remainder of the collimator tube can swing through an angle limited by the divergent portion of the bore. If the articulation is a ball joint, the collimator tube can swing through a solid angle and the divergent portion of the bore is essentially conical, but it is also practical to provide a roller joint articulation, in which case the divergence of the diverging part of the bore need diverge only in one plane and the collimator tubes swing through a plane angle. In any case the shielding, provided by the part of the shield plate not hollowed out for the purposes described and by the bearing-forming portions of the collimator tubes, is made sufficiently great so that no disturbance rays can get into the collimator tubes.

The pivoted arrangement of the collimator tubes in the shield plate make it possible to aim the respective detectors at the same target portion of the object to be examined. If desired, the direction of observation of each of the individual detectors in the object field can be made visible by sighting lights. In spite of the movability of the collimator tubes about their pivots, a fully effective shielding is provided against disturbing rays in every position of the collimator tubes.

In cases in which it is important to locate the detectors of a multiple collimator according to the invention as close to each other as possible, the diameter of the articulated joints of the shield plate and collimator tubes must be kept as small as possible. In such cases it is practical to put the articulated joints on the side of the multiple collimator apparatus that faces the object to be observed and thereby to assure that the shield plate together with the bearings provides sufficient mass for screening off disturbing rays. In particular cases it can also be practical to constitute the collimator tubes in such a way that they project beyond the shield plate towards the object.

The multiple collimator of the present invention is provided by fitting a body rotatably mounted for rotation about its axis of symmetry into a bore of corresponding shape with the rotatable body having a cavity for a collimator tube mounted so as to be pivoted or rotatable therein, the collimator tube and the cavity for it fitting each other in shape. The cavity and the collimator tube fitted into it can be made in different ways according to the particular application in which it is desired to use the apparatus.

One of the possible variations of the last-mentioned kind of construction of the multiple collimator according to the invention is the provision of a prismatically shaped cavity in the rotatable body, into which a collimator tube having a rectangular stem is pivoted so that it can swing about an axis running perpendicular to the axis of rotation of the rotatable body. Another variation consists in providing, in the rotatable body, a conical cavity with an axis of symmetry running eccentrically in the rotatable body, while the bore through the collimator tube rotatably mounted in the cavity is arranged eccentrically to the axis of rotation of the collimator tube. In both cases essentially four degrees of freedom of rotation are provided for the adjustment of the movable collimator tube through two simple bearings, so that the setting of the movable collimators can be read by use of two scales. It is therefore appropriate to provide scale graduations on the shield plate and/or on the body rotatable in the bore for determining the angular position of the rotatable body and also scale graduations on the body rotatable in the bore and/or on the collimator tube for determining the position of the collimator tube.

The various embodiments of the multiple collimator with collimators adjustable in their respective positions have the advantage that—apart from the reproducibility of the adjustment—statistical data can readily be obtained from which a normal setting, the typical deviations and an optimization of the adjustment procedure can be derived. Thus, for example, the two breast nipples of the patient can for example serve as reference points. With approximately point-shaped radiation regions, the space coordinates of the latter can also be determined.

The multiple collimator according to the invention has the great advantage that the detectors can be fitted in an optimum fashion taking account of the object to be measured. A further advantage is that the fields of view of the collimator tubes can be compressed substantially closer together and in the case of combinations of individual collimators, without impairing the effectiveness of shielding. The apparatus, moreover, is particularly well suited for functional analysis of individual organs or segments of organs in using a procedure making use of radioactive marker materials.

The invention is further described by way of example with reference to the annexed drawings, in which:

FIG. 4 is a top view of an embodiment of the multiple collimator according to the invention;

FIG. 5 is a section through the multiple collimator apparatus of FIG. 4 along the line A–B;

Figure 1:
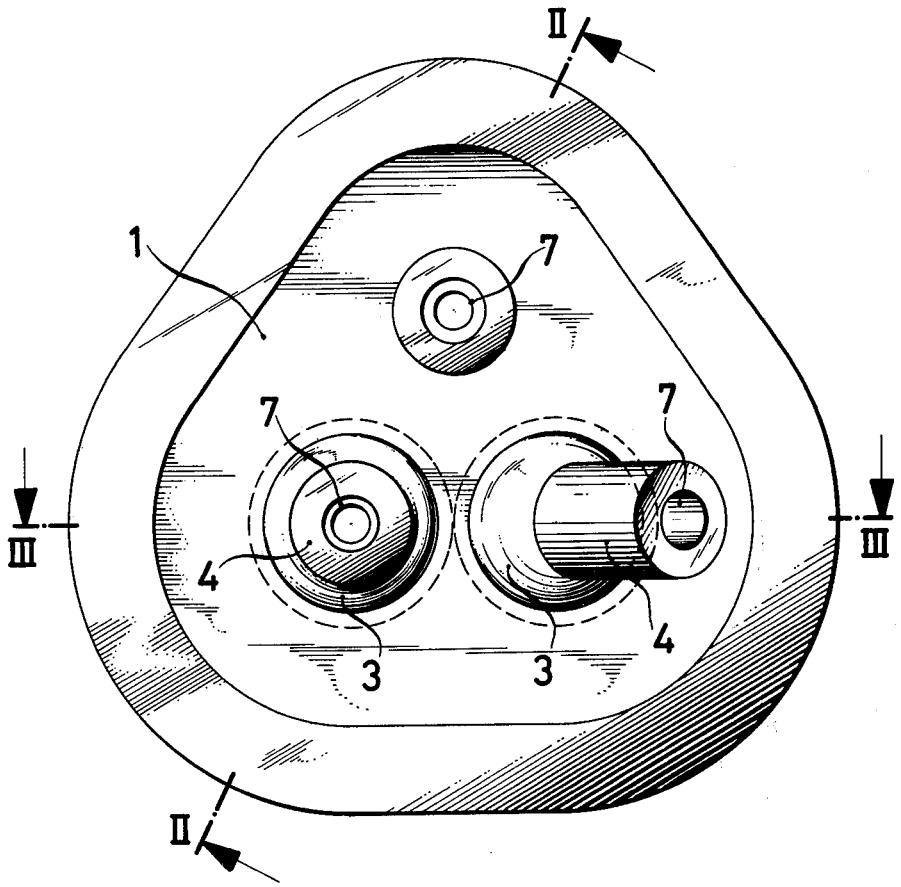
FIG. 1 is a top view of a first embodiment of the multiple collimator by which basic principles are explained.
Figure 2:
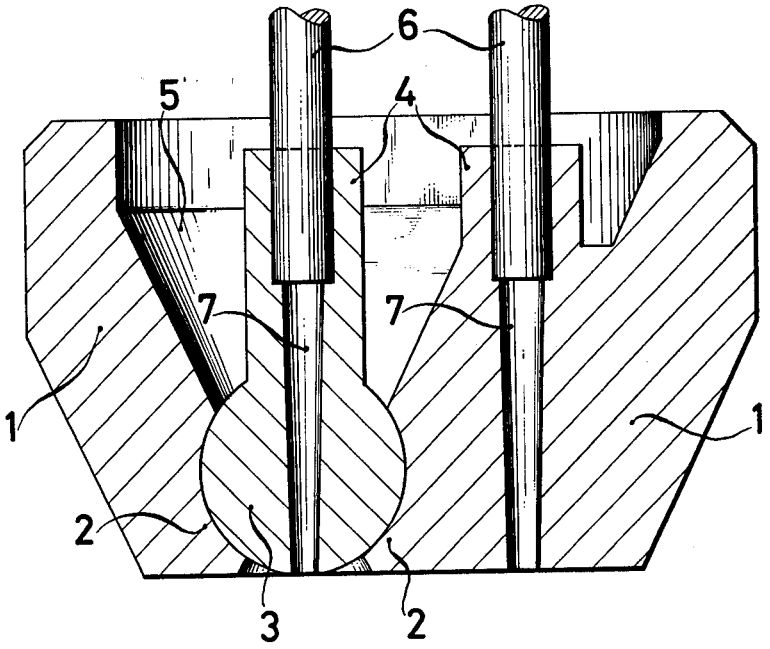
FIG. 2 is a section through the multiple collimator apparatus of FIG. 1 along the line A–B.
Figure 3:
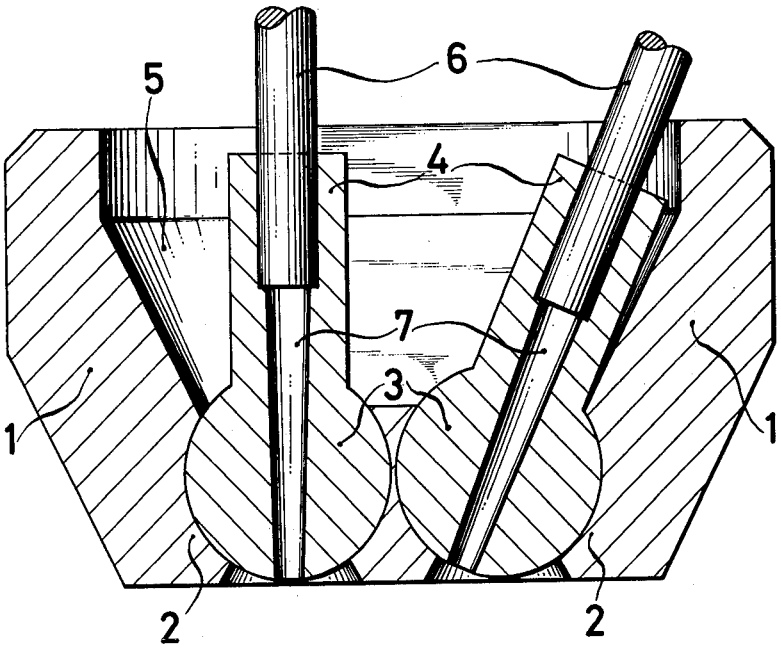
FIG. 3 is a section through the multiple collimator apparatus of FIG. 1 along the line C–D.

In the basic example of a multiple collimator shown in FIGS. 1 to 3 spherical cavities are provided in two of the three bores passing through the shield plate 1, into each of which a portion of the collimator tube 4 is so engaged that a ball joint is formed in each case, and the collimator tubes 4 are accordingly arranged to swivel about the respective ball joints. In order to provide a swiveling range of a width sufficient for the various examinations of objects containing a radioactive source, the remaining portion 5 of the bores here under discussion are extended in conical shape for a part of their axial length. As is particularly clear from FIG. 3, as a result of this configuration it is made possible to set the position of the detectors 6 that are inserted in the collimator tubes 4 suitably to the desired requirements.

The bores 7 defining the inside of the collimator tubes 4 are shaped conically for better focusing. It is of course possible also to make the bores through the collimator tubes 4 cylindrical. By the provision of the widened spherically shaped portion 3 of the collimator tube 4, in combination with the remaining portion of the shield plate 1, a sufficient shielding against the penetration of disturbing rays into the measuring detectors 6 mounted on the collimator tubes 4 is provided.

In the first embodiment of a multiple collimator apparatus of the present invention illustrated in FIGS. 4 and 5, just as in the one shown in FIGS. 1 to 3, there are provided one fixed and two movable measuring detectors. The shield body 1 is again of more or less frustoconical form and in it, in addition to the fixed collimator bore 22 there are two conical bores for seating the adjustable collimators. On each of the conical bores there is mounted in a ball bearing 8 a body 9 that has a prismatic cavity 23 in which the stem portion of rectangular cross section of an adjustable collimator 4*a* is mounted so that it can pivot on pivot studs 10 journalled in the body 9, only one of these studs 10 being shown, diagrammatically, in FIG. 5. The rotational position of the body 9 can be read off at the index mark 12 from the circularly arranged scale 11. The adjustment of the collimators can be read on an arc-shaped scale 13 at the index mark 14 carried on the collimator.

By actuating a push-knob 15 that, when pushed in, presses down a clamping spring (not shown) at the side wall of the body 9, the latter is set free to revolve on the bearing 8 so that its position can easily be set. Release of pressure on the knob 15 causes the unshown spring to hold the body 9 in the set position.

For swinging the movable collimator about its horizontal pivot axis, the knob 16 is pressed in, pulling off a clamping spring (not shown) from the inner surface of the cone, allowing the collimator body 4a to pivot. Release of the protruding button 16 causes a spring to hold the collimator body 4a in position.

By inserting of small chocks such as the chock 17 shown in FIG. 5 the gaps in the shielding body can be practically prevented from reducing appreciably the extent of shielding of the collimators from any direction.

Figure 6:
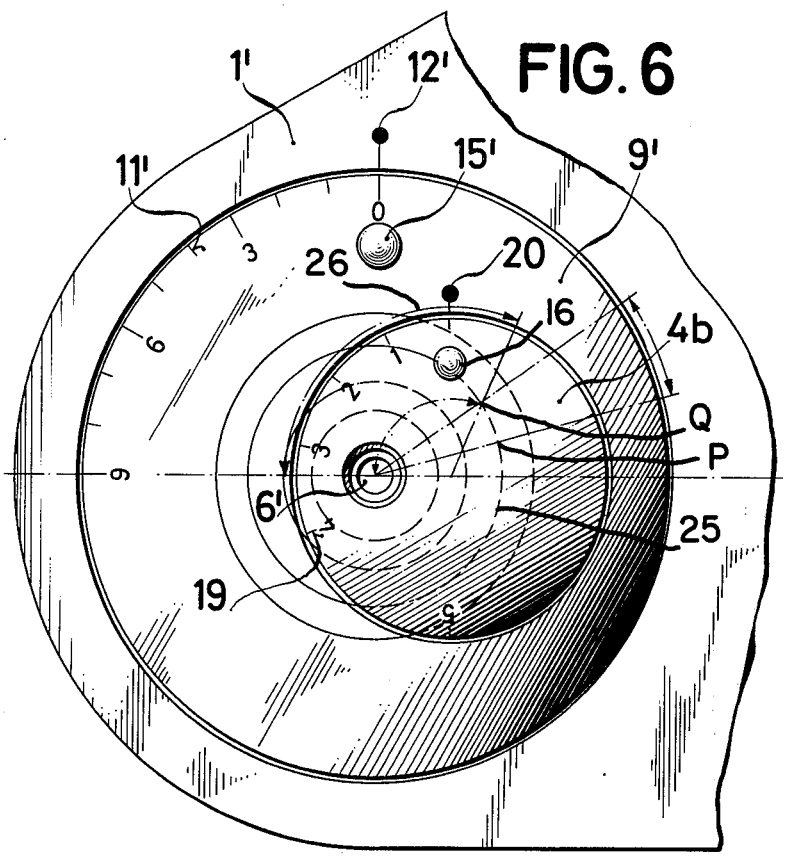
FIG. 6 is a partial top view of a second embodiment of the multiple collimator apparatus according to the invention.
Figure 7:
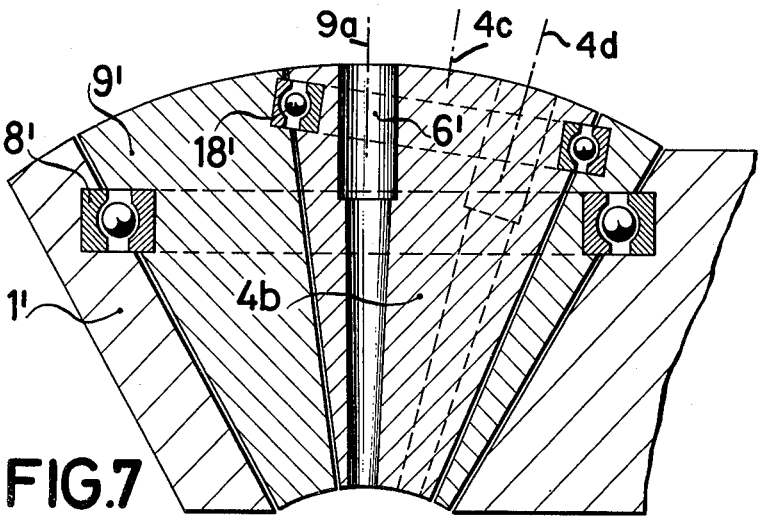
FIG. 7 is a section through the portion of the multiple collimator apparatus shown in FIG. 6, through the line A–B of FIG. 6.

In the form of construction illustrated in FIGS. 6 and 7, just as in the form shown in FIGS. 4 and 5, in each of two generally conical bores there are provided frustoconical bodies 9 that are mounted in ball bearings 8 for rotation about their respective axes of symmetry. These axes could be slightly off the vertical as shown in FIG. 5, but FIG. 7 shows that the frustoconical body 1 can be arranged to provide for a vertical axis for the body 9 revolving in a conical bore in the body 1. It is held against rotation in its bearings by a spring stud, not shown, that can be taken out of engagement by pressure on the button 15 so that the body 9 can revolve. The angle of rotation can be read off at the index marker 12 on the scale 11 marked on the circular rim of the top of the body 9.

As can be seen from FIG. 7, an eccentric conical bore is provided in the body 9, in which a collimator tube body 4b is held rotatably by means of the ball bearings 18. The collimator tube body 4b has an eccentrically located collimator bore in the top of which a detector is located at 6. When the body 4b is rotated in its ball bearing 18 so that the axis of the collimator bore coincides with the axis of rotation of the body 9, in the particular position illustrated in FIG. 7, it is then vertical and this position can be indicated on the rim scale of the collimator body 4b as the zero position, as shown in FIG. 6 opposite the scale index marker 20 engraved in the body 9. By revolving the collimator body 4b about its axis 4c, the axis 4d of the collimator bore increases its inclination to the axis 9a of the conical body 9 from zero in the position shown in solid lines in FIG. 7 to a maximum reached by a rotation of 180° into the position shown in dotted lines in FIG. 7. The inclination of the axis 4d of the collimator bore to the axis 4c in the illustrated case, which is also the inclination of the axis 4c to the axis 9a, is 15°. The scale 19 is so subdivided that each scale division marks an amount of rotation that corresponds to an inclination increase of 3°. The collimator body 4b is also provided with a stopping or holding device (not shown) that can be disengaged by pressing on a button 16.

The form of multiple collimator apparatus shown in FIGS. 6 and 7 lends itself to aiming each collimator unit at a particular point P in an object plane by reference to polar coordinates, in which case the scale 19 can adjust the length of the radius from a point of origin and the scale 11 an angle defining the radius vector. The adjustment of the collimator to aim it at a point P is carried out, for example, by turning the collimator body 4b by rotation to the right up to scale division 4, which swings the collimator off the vertical by $4\times3°=12°$. As shown in FIG. 6, this brings the aiming point of the collimator from the center of the diagram through an arc shown by a dotted line to a point Q on the circle 25 which has a desired radius. The rotation movement is indicated by the arrow 26. Then body 9 is rotated to index the second scale division and the effect on the aiming point of the collimator is indicated by the arrow 27. This brings the collimator to the point P. Thus the pair of scale coordinates 4, 2 used in this case uniquely defines the point P and the collimator can be reset to that point after having been moved in the meanwhile to some other position.

The particular advantage of the form of construction shown in FIGS. 6 and 7 for a multiple collimator according to the invention is that the shielding of the detectors has no weak spots formed by cavities or gaps and indeed has no asymmetry, while the reading off of polar coordinates is unusually convenient.

Although the invention has been described with reference to particular illustrative examples, it will be recognized that modifications and variations are possible within the inventive concept. Thus, for example, collimator bodies swiveling about a defined axis like the collimator bodies 4b of FIG. 4 could be journaled directly in the shield body 1 as in FIG. 1 (i.e. forming a roller joint instead of a ball joint) rather than in rotary intermediate bodies 9 as in FIG. 4. This would restrict adjustability, but it might be usefil where the collimators are designed to be all aimed at a selectable point on the fixed axis of a fixed collimator, in which case the swivel collimators would swing about horizontal axes perpendicular to the axis of the fixed collimator.

We claim:

1. A multiple collimator comprising:

a thick shield plate member opaque to penetrative radiation (1);

a plurality of bores traversing said shield plate and so shaped as to provide a frustoconically shaped cavity surface;

a rotatable body (9) of material opaque to penetrative radiation rotatably mounted in each of said bores having a frustoconical surface fitting the frustoconical surface of the bore, and having also a cavity for mounting, at an adjustable angle to the axis of said rotary body, a collimator tube body, said cavity being open through the end faces of said rotary body, and a collimator tube body (4a, 4b) of material opaque to penetrative radiation having a collimator tube bore therethrough and movably mounted in said cavity of each of sair rotary bodies so as to permit variation of the angular position of said collimator tube bore with respect to said shield plate (1), the collimator tube bore of each of said collimator tube bodies (4a, 4b) having a portion shaped for removably seating a radiation detector (6).

2. A multiple collimator as defined in claim 1, in which said cavity in said rotatable body (9) has a portion of prismatic shape and said collimator tube body (4a) seated therein has a portion shaped with two parallel sides fitting parallel plane walls of said prismatic portion of said cavity and is mounted so as to be able to swing about an axis perpendicular to the axis of rotation of said rotary body.

3. A multiple collimator as defined in claim 1, in which said cavity in said rotatable body (9) is of conical shape having an axis running eccentrically in said body with respect to the axis of symmetry and rotation of said body and in which the said collimator tube (4b) is rotatably mounted in said cavity and has a collimator bore therethrough which is disposed eccentrically with respect to the axis of rotation of said collimator tube (4b).

4. A multiple collimator as defined in any one of claims 1 to 3, in which a scale is provided on said shield plate (1) for determining the angular position of said rotatable body (9).

5. A multiple collimator as defined in any one of claims 1 to 3, in which a scale is provided on said rotatable body (9) for determining the angular position of said rotatable body.

6. A multiple collimator as defined in any one of claims 1 to 3, in which a scale is provided for determining the position of each collimator tube relative to said rotatable body.

7. A multiple collimator as defined in any one of claims 1 to 3, in which a fixed collimator bore is also provided, said fixed collimator bore having a position into which a radiation detector can be removably seated.

* * * * *